US009199701B2

(12) United States Patent
Sahr et al.

(10) Patent No.: US 9,199,701 B2
(45) Date of Patent: Dec. 1, 2015

(54) PRIVACY ENCLOSURE FOR BOAT

(71) Applicant: Larson Boats, LLC, Hopkins, MN (US)

(72) Inventors: Ron Sahr, Cushing, MN (US); Gary Becker, Little Falls, MN (US); Chris Backowski, Cushing, MN (US); Leon C. Raiter, Sartell, MN (US)

(73) Assignee: Larson Boats, LLC, Hopkins, MN (US)

( * ) Notice: Subject to any disclaimer, the term of this patent is extended or adjusted under 35 U.S.C. 154(b) by 0 days.

(21) Appl. No.: 14/459,974

(22) Filed: Aug. 14, 2014

(65) Prior Publication Data

US 2015/0047549 A1 Feb. 19, 2015

Related U.S. Application Data

(60) Provisional application No. 61/866,321, filed on Aug. 15, 2013.

(51) Int. Cl.
*B63B 29/14* (2006.01)

(52) U.S. Cl.
CPC ..... *B63B 29/14* (2013.01)

(58) Field of Classification Search
CPC ..... B63B 29/14
USPC ..... 114/361
See application file for complete search history.

(56) References Cited

U.S. PATENT DOCUMENTS

| | | | | |
|---|---|---|---|---|
| 2,538,736 | A | 1/1951 | Spencer | |
| 2,827,004 | A * | 3/1958 | Luce et al. | 109/1 S |
| 4,883,016 | A * | 11/1989 | Larson | 114/363 |
| 4,979,242 | A * | 12/1990 | Maggio | 4/449 |
| 5,029,348 | A * | 7/1991 | Boren | 4/449 |
| 5,379,466 | A * | 1/1995 | Davies | 4/449 |
| 6,701,863 | B2 * | 3/2004 | Kalhok et al. | 114/361 |
| 6,721,967 | B2 * | 4/2004 | Braxton | 4/664 |
| 6,910,230 | B1 * | 6/2005 | Schimmel | 4/300 |
| 7,117,646 | B2 * | 10/2006 | Blaisdell et al. | 52/79.5 |
| 8,899,168 | B1 * | 12/2014 | Fodor et al. | 114/361 |
| 2001/0044952 | A1 * | 11/2001 | Becker | 4/449 |
| 2003/0127034 | A1 * | 7/2003 | Scott et al. | 114/61.1 |
| 2005/0011430 | A1 * | 1/2005 | Blaisdell et al. | 114/361 |
| 2005/0235901 | A1 * | 10/2005 | Blaisdell et al. | 114/361 |
| 2015/0047549 | A1 * | 2/2015 | Sahr et al. | 114/361 |

* cited by examiner

*Primary Examiner* — Lars A Olson
*Assistant Examiner* — Jovon Hayes
(74) *Attorney, Agent, or Firm* — Merchant & Gould P.C.

(57) ABSTRACT

A pontoon boat includes a plurality of sponsons, a deck mounted on the sponsons, and a privacy enclosure mounted on the deck. The privacy enclosure has a bottom section and a top section, both of which have a rigid construction. The top section is telescopically moveable in a vertical orientation relative to the bottom section between a retracted position and an extended position. The top section is situated over, and covers the bottom section when in the refracted position, with a majority of the top section projecting upwardly from the bottom section when in the extended position.

15 Claims, 5 Drawing Sheets

PRIVACY ENCLOSURE FOR BOAT

CROSS REFERENCE TO RELATED APPLICATION

This application claims the benefit of U.S. Provisional Application No. 61/866,321, filed Aug. 15, 2013, and titled "Privacy Enclosure for Boat," the disclosure of which is hereby incorporated herein by reference.

BACKGROUND

This disclosure relates generally to a privacy enclosure, and more particularly, to a stowable privacy enclosure for use on a boat.

A wide variety of enclosure arrangements have been provided for personal use on boats. A number of such enclosure arrangements include a soft-sided or fabric arrangement, such as a rail and curtain arrangement. In some arrangements, a curtain is drawn around an area for use as a changing area or a private toilet area. In other arrangements, a soft-sided fabric canopy unfolds to enclose a changing or toilet area.

The soft-sided fabric/curtain arrangements have several drawbacks. For instance, conventional curtain or fabric arrangements provide little to no structural stability, which can cause safety concerns in conditions when the boat is rocking and a user loses his or her balance. Without structural supports and having nothing to grasp, a user may fall through the curtain or fabric sides of the enclosures. Another drawback of these conventional arrangements is a lack of secured privacy, which can arise when the wind is blowing and the curtain or fabric side blows up or open. In addition, soft-sided arrangements generally provide no noise privacy or noise dampening that in tight quarters on a boat is desirable.

SUMMARY

In accordance with certain teachings of the present disclosure, a pontoon boat includes a plurality of sponsons, a deck mounted on the sponsons, and a privacy enclosure mounted on the deck. The privacy enclosure has a bottom section secured to the deck, with a rigid construction including a rigid rear bottom wall, a rigid left bottom wall, a rigid right bottom wall and a rigid front bottom wall. The rigid front bottom wall has a lower door opening therein. A rigid lower door panel is hingedly attached to the rigid front bottom wall. A top section of the enclosure has a rigid construction including a rigid rear top wall, a rigid left top wall, a rigid right top wall, a rigid roof, and a rigid front top wall. The rigid front top wall has an upper door opening therein with a rigid upper door panel hingedly attached to the rigid front upper wall. The top section is telescopically moveable in a vertical orientation relative to the bottom section between a retracted position and an extended position. The top section is situated over, and covers the bottom section when in the retracted position, with a majority of the top section projecting upwardly from the bottom section when in the extended position.

In accordance with further aspects of the disclosure, the enclosure includes a powered lift system configured to move the enclosure between the retracted and extended positions. The lift system includes a lift plate slidably attached to the bottom section of the enclosure such that the lift plate is movable relative to the bottom section. A first linear actuator has a first end attached to the bottom section and a second end attached to the lift plate. The second end is linearly movable relative to the first end such that when actuated the second end slides the lift plate vertically relative to the bottom section. A second linear actuator has a first end attached to the lift plate and a second end attached to the top section. The second end is linearly movable relative to the first end such that when actuated the second end moves the top section vertically relative to the lift plate and the bottom section.

DETAILED DESCRIPTION

Figure 1:
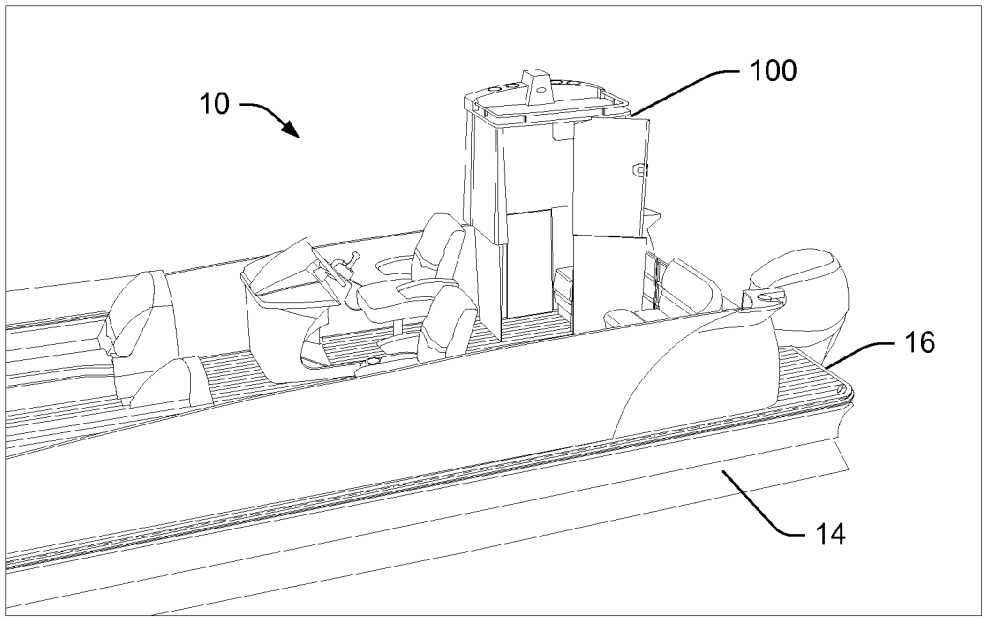
FIG. 1 illustrates an example of a pontoon boat having a privacy enclosure in accordance with aspects of the present disclosure.

FIG. 1 illustrates aspects of a pontoon boat 10 in accordance with certain teachings of the present disclosure. The boat 10 includes a plurality of sponsons or floats 14 with a deck 16 mounted thereon. A privacy enclosure 100 is mounted on the deck, and in some implementations is configured for use as a private changing or toilet area, for example. The enclosure 100 is illustrated in use on a boat, for example, the pontoon boat 10. It is contemplated that the principles of the present disclosure can be practiced to adapt the disclosed privacy enclosure 100 for use on a variety of boat types, or for use in a variety of non-boat related applications.

Among other things, the example privacy enclosure 100 generally includes a telescoping enclosure structure having a rigid construction. In FIG. 1, the enclosure 100 is illustrated in an extended position. As used herein, a rigid construction is a construction that is more rigid than a curtain, for example. The walls of the enclosure structure are sufficiently rigid so that the walls are self-supporting and maintain a particular shape without additional structural support. That is, the enclosure structure can maintain an area and volume without, for example, struts, arms, trusses, a framework, or railings as required by some conventional fabric or curtain arrangements. In some implementations, the rigid components of the enclosure 100 are fabricated from fiberglass, which provides the desired rigidity and other characteristics suitable for use on a boat such as the pontoon boat 10.

Figure 2:
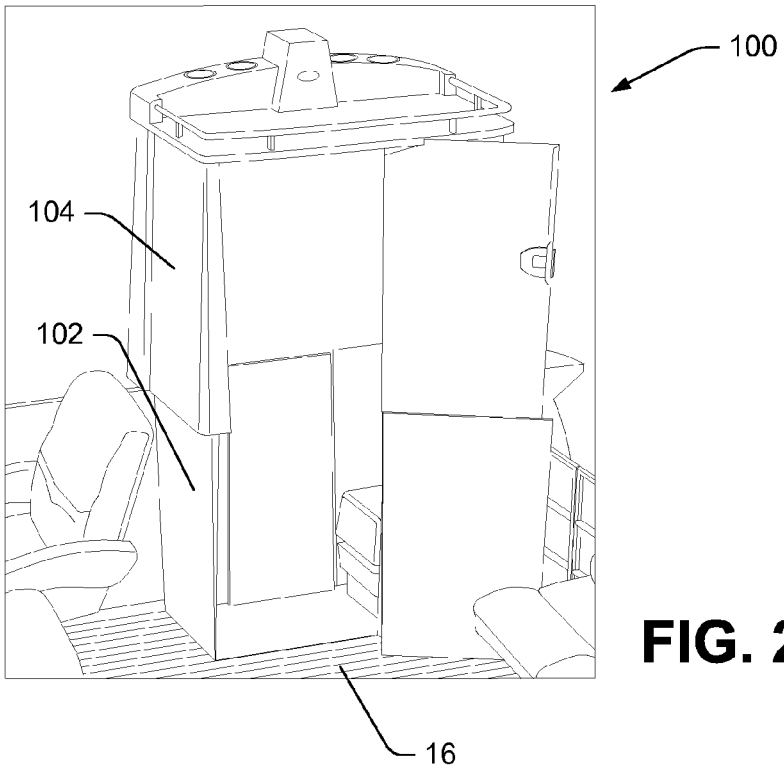
FIG. 2 illustrates an example privacy enclosure in an extended position.
Figure 3:
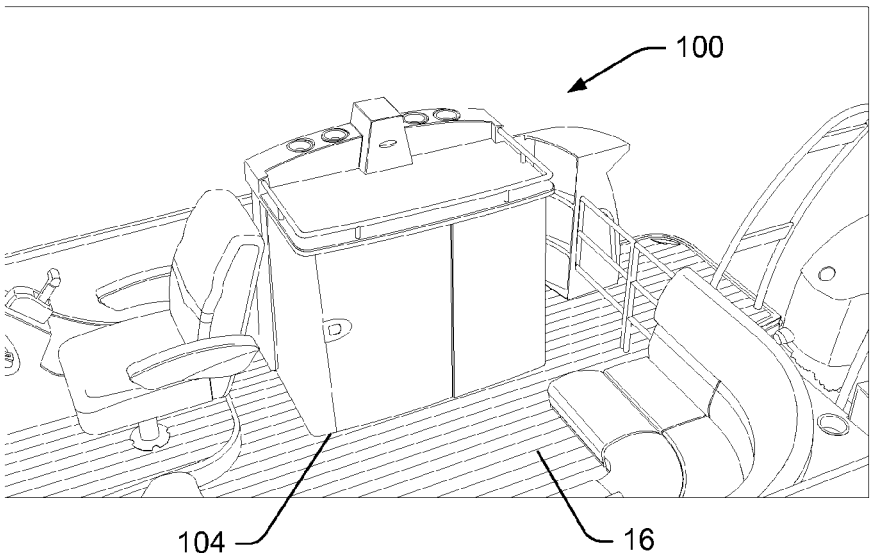
FIG. 3 illustrates the example privacy enclosure of FIG. 2 in a retracted position.

FIG. 2 illustrates an example of the privacy enclosure 100 shown in the extended position. The enclosure 100 includes a bottom section 102 that is secured to the deck 16 of the pontoon boat 10, and a top section 104. When in the extended position illustrated in FIG. 2, a majority of the top section 104 projects upwardly from the bottom section 102. In FIG. 3, the enclosure 100 is illustrated in a retracted position, in which the top section 104 is situated over and covers the bottom section 102. In the retracted position illustrated in FIG. 3, the top section 104 completely covers the bottom section 102, such that the bottom section 102 is not visible when in the retracted position.

Figure 4:
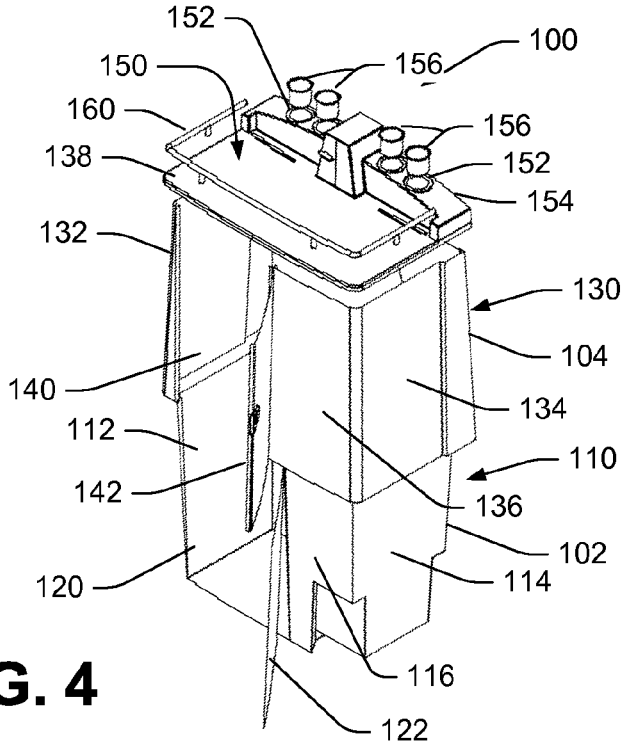
FIG. 4 is an exploded front perspective view of a privacy enclosure in accordance with aspects of the present disclosure.

FIG. 4 is an exploded perspective view of an example of the enclosure 100. The bottom section 102 has a rigid construction including a rigid rear bottom wall 110, a rigid left bottom wall 112, a rigid right bottom wall 114 and a rigid front bottom wall 116. The rigid front bottom wall 116 has a lower door opening therein 120, and a rigid lower door panel 122 hingedly attached to the rigid front bottom wall.

The top section 104 has a rigid construction with a rigid rear top wall 130, a rigid left top wall 132, a rigid right top wall 134, a rigid front top wall 136 and a rigid roof 138. The rigid front top wall 136 has an upper door opening 140 therein, with a rigid upper door panel 142 hingedly attached to the rigid front upper wall 136. The top section 104 is telescopically moveable in a vertical orientation relative to the bottom section 104 between the retracted position shown in FIG. 3 and the extended position shown in FIG. 2.

In some implementations, the lower and upper door panel portions 122,142 are independently pivotally movable between an open position and a closed position. In other words, the door panel portions 122,144 are not connected to one another in either the refracted or extended positions. Further, the door panels 122,142 are positioned such that they are movable to the opened and closed positions in both the extended and retracted positions. Thus, the interior of the enclosure 100 is accessible without requiring moving the enclosure 100 to the extended position. For instance, if the enclosure 100 is used for storage, stored items can be easily accessed and removed from the enclosure 100 as desired without moving the enclosure to the extended position. Further, in some examples, the door panels 122,142 are attached to the respective front bottom and top walls 116,136 by hinges such that the door panels 122,142 swing outwardly from the enclosure 100. This makes it easier for a person inside the enclosure 100 to move about and exit the enclosure 100.

In some examples, a top side 150 of the rigid roof 138 forms the top of a counter when the top section 104 is in the retracted position as shown in the embodiment illustrated in FIG. 3. Generally cylindrical recesses 152 are formed in a back, upwardly extending section 154 that can be used for drink holders. The recesses 152 themselves can be sized and configured to receive beverage cups, cans, bottles, etc., or inserts 156 for holding such beverage containers can be seated in the recesses 152. In one implementation, four drink holders are included, and the recesses are about 4 inches in diameter and about 3 inches deep.

Figure 5:
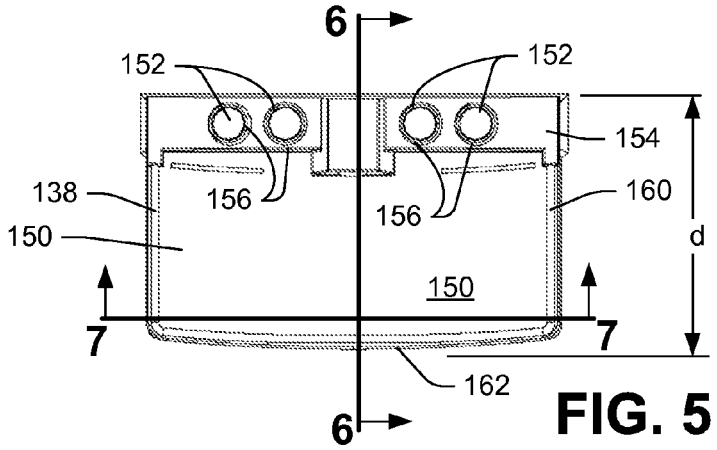
FIG. 5 is a top view of the privacy enclosure shown in FIG. 4.

A railing 160 extends around the side and front periphery of the top side 150. In some embodiments, the rigid roof 138 includes peripheral portions 162 that overhang the top section 104, as shown in FIG. 5. In some examples, the front peripheral portion 162 overhangs the rigid front top wall 136 and upper door panel 142 (when in the closed position) by about 1.0 to 1.5 inches.

Figure 6:
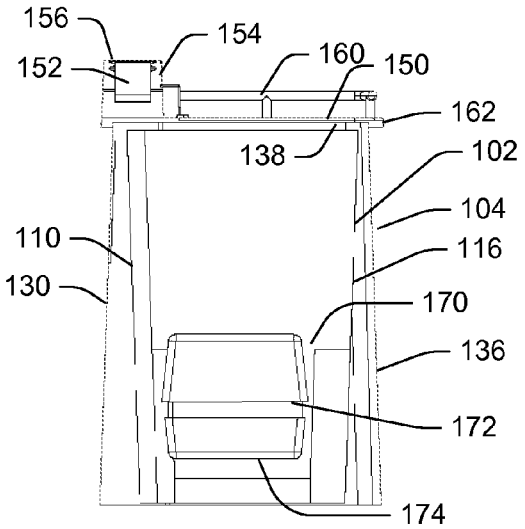
FIG. 6 is a sectional side view of the privacy enclosure taken along line 6-6 in the direction of the arrows shown in FIG. 5.
Figure 7:
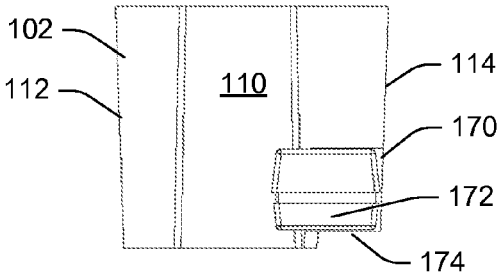
FIG. 7 is a sectional rear view taken along line 7-7 in the direction of the arrows shown in FIG. 5.

Some embodiments of the enclosure 100 are configured to include a toilet 172 therein, as shown in FIGS. 6 and 7. The toilet 172 is typically a portable-type toilet having a removable tank, or a type that can be emptied at a pump station. Some implementations use portable toilets from Thetford Corporation (www.thetford.com). In the example shown in FIGS. 6 and 7, the bottom section 102 defines recessed area 170 for receiving the toilet 172. Alternatively, if the enclosure 100 is not used as a private toilet area, the recess 170 could be used for storage. In the illustrated example, the rigid right bottom wall 114 and portions of the rigid rear bottom wall 110 and the rigid front bottom wall 116 adjacent to the rigid right bottom wall 114 are molded so as to form the recess 170. The recess 170 includes a raised bottom surface 174 that positions the toilet 172 above the deck 16 of the boat 10. In some examples, the raised bottom surface 174 is positioned from about 2 to 3 inches above the deck 16. In other examples of the enclosure 100, the raised portion is not included, or it is an added riser component that is not molded into the rigid walls of the enclosure 100.

Figure 9:
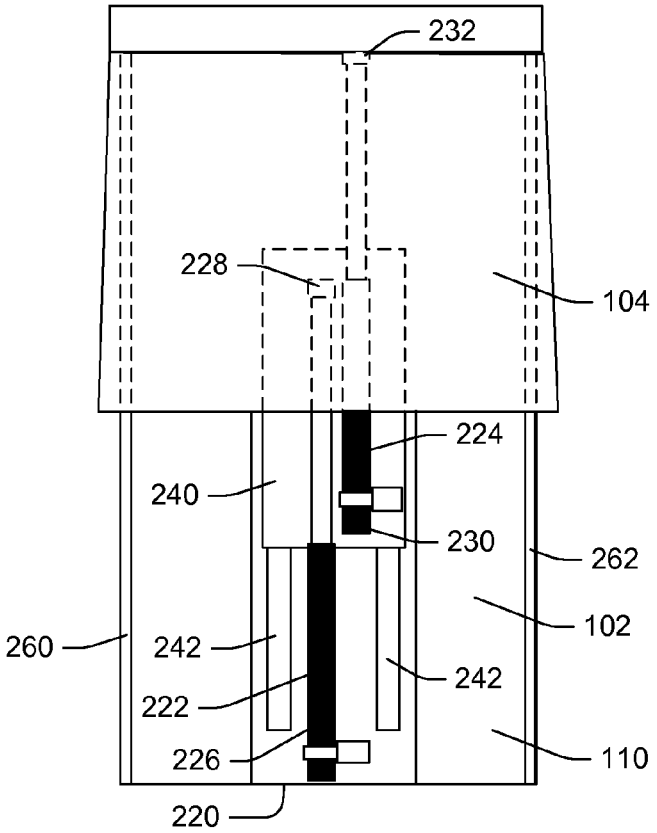
FIG. 9 is a rear view of the privacy enclosure illustrating a powered lift system.

The top section 104 can be telescopically moved in the vertical orientation relative to the bottom section 102 in several different ways. In certain embodiments, an automated lift device is used for raising and lowering the top section 104 relative to the bottom section 102. In some examples, a linear actuator is used for this purpose. FIG. 9 is a rear view of an example of the enclosure 100 including a powered lift system. In a simple linear actuation system, rotary motion is generated using an electric motor, and the rotary motion is then converted into linear motion via the use of a screw assembly.

In the example shown in FIG. 9, first and second linear actuators 222, 224 are received within a channel 220 defined in the rear bottom wall 110. A lift plate 240 is slidably attached to the bottom section 102 such that the lift plate 240 is movable relative to the bottom section 102. In the illustrated embodiment, the lift plate 204 slides on a pair of slide rails 242 attached to the bottom section 102. The first linear actuator 222 has a first end 226 attached to the bottom section 102 and a second end 228 attached to the lift plate 240. The second linear actuator 224 has a first end 230 attached to the lift plate 240 and a second end 232 attached to the top section 104.

The second ends 228,232 of the first and second linear actuators 222,224 are linearly movable relative to the respective first ends 226,230. Thus when actuated, the second end 228 of the first actuator 222 slides the lift plate 240 upwardly, which lifts the first end 230 of the second actuator 224. When the second end 232 of the second actuator 224 is extended, it pushes the top section 104 vertically upwardly to extend the top section 104 relative to the bottom section 102. If the first and second actuators 222,224 are actuated simultaneously, the enclosure 100 is moved from the retracted (down) position to the extended (up) position much more quickly than if only a single actuator were used.

In some implementations, Acculift linear actuators (http://www.qmigroup.com/acculift/linear_actuators.cfm) are employed. Respective electric motors 250, 252 are operated to extend the second ends 228, 232 as desired to raise or lower the top section 104. The motors 250,252 can be powered by the battery on the boat 10. Respective sections of metal slide rails 260, 262 are attached to the bottom and top sections 102, 104 to facilitate the telescoping movement of the top section 104. In the illustrated example, the slide rails 260,262 are attached to the left and right bottom walls 112, 114 and the left and right top walls 132, 134, such that the slide rails 260,262 are oriented generally perpendicularly to the slide rails 242 upon which the lift plate 240 moves. Such positioning of the slide rails 260, 262, 242 increases stability of the enclosure 100 when in the extended position.

Figure 8:
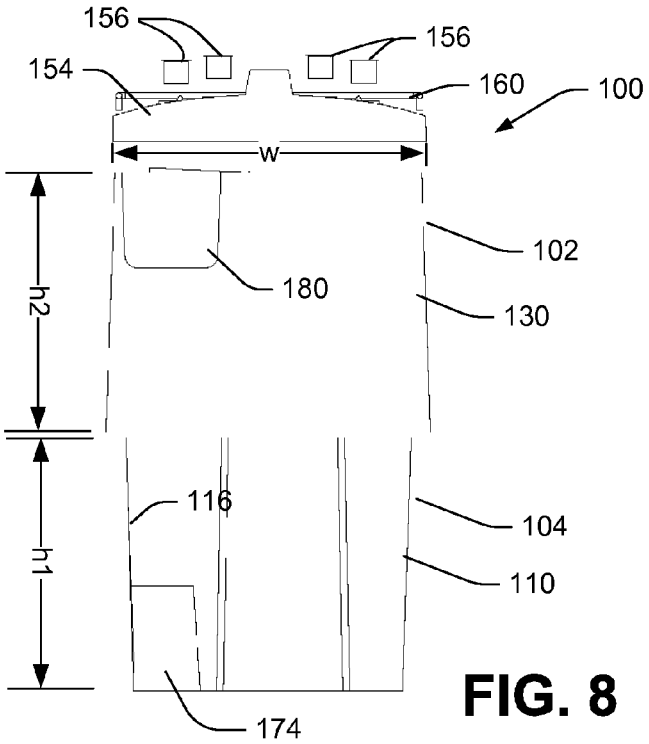
FIG. 8 is an exploded rear view of the privacy enclosure shown in FIG. 4.

FIG. 8 is an exploded rear view of another example of the enclosure 100. The illustrated top section 104 includes a recessed area 180, in which a transparent or translucent panel is placed to admit natural light to the interior of the enclosure 100. In other embodiments, such as that illustrated in FIG. 9, the transparent panel is omitted. In one particular embodiment, the bottom section 102 has a height dimension h1 of about 33 inches, and the top section 104 has a height dimension h2 of about 34 inches.

Thus, when in the extended position, the enclosure 100 has an inside height of about 67 inches. The height dimensions may vary, for example, based on the height of a bimini top or other roof structure of the particular boat 10 on which the enclosure 10 is situated. The illustrated enclosure has a width dimension w of about 46 inches and a depth dimension d of about 28 inches. The illustrated example has a nominal draft angle of 2°.

Figure 10:
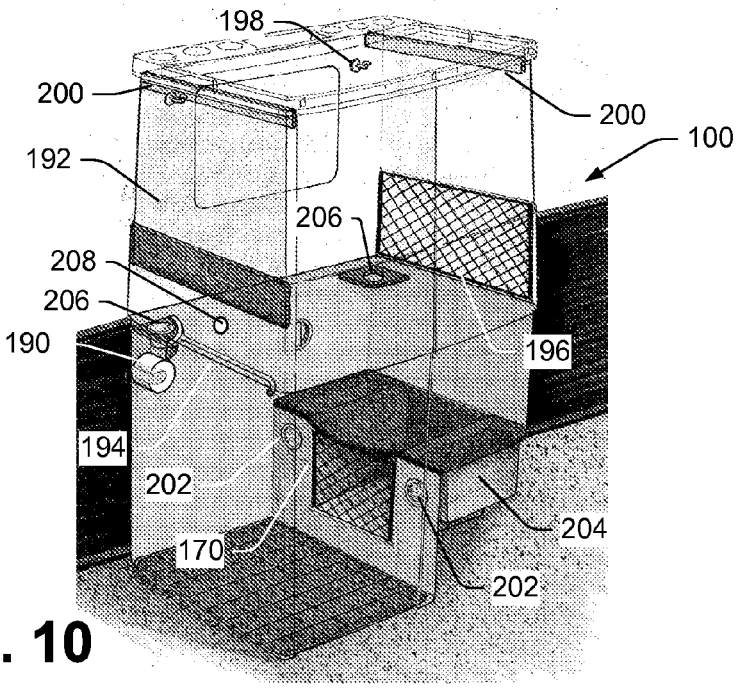
FIG. 10 illustrates examples of items included in some embodiments of the disclosed privacy enclosure.

FIG. 10 illustrates examples of various items that are included inside the enclosure 100 in some embodiments. The illustrated example includes a toilet paper dispenser 190, a mirror 192, a grab bar 194, a storage net 196 for wet towel or swimming suit storage, clothes/towel hooks 198, and light bars 200 including, for example, LED lights. Vents 202 are included on either side of the recess 170, and in some examples one or more vent fans 204 are also situated in the recess 170. Cup holders 206 are provided for holding drinks, hand sanitizer, etc. A control switch 208 is located inside the enclosure 100, and is operably connected to the linear actuators 222,224 to raise and lower the enclosure 100 as desired. Placing the control switch 208 inside the enclosure 100 helps insure that the enclosure 100 isn't returned to the retracted position while a user is inside the enclosure 100.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A pontoon boat comprising:

a plurality of sponsons;

a deck mounted on the sponsons;

a privacy enclosure mounted on the deck, the privacy enclosure including:

a bottom section secured to the deck, the bottom section having a rigid construction including a rigid rear bottom wall, a rigid left bottom wall, a rigid right bottom wall and a rigid front bottom wall, the rigid front bottom wall having a lower door opening therein;

a rigid lower door panel hingedly attached to the rigid front bottom wall;

a top section having a rigid construction including a rigid rear top wall, a rigid left top wall, a rigid right top wall, a rigid roof, and a rigid front top wall, the rigid front top wall having an upper door opening therein;

a rigid upper door panel hingedly attached to the rigid front upper wall;

the top section being telescopically moveable in a vertical orientation relative to the bottom section between a retracted position and an extended position, the top section situated over and covering the bottom section when in the retracted position, a majority of the top section projecting upwardly from the bottom section when in the extended position.

2. The pontoon boat of claim 1, wherein the rigid lower and upper door panel portions are independently pivotally movable between an open position and a closed position.

3. The pontoon boat of claim 1, wherein a top side of the rigid roof forms a counter when the top section is in the retracted position.

4. The pontoon boat of claim 3, wherein the rigid roof has peripheral portions that overhang the top section.

5. The pontoon boat of claim 3, wherein the rigid roof includes a rail extending around at least a portion of a periphery of the rigid roof.

6. The pontoon boat of claim 1, further comprising a lift device configured to selectively raise and lower the top section relative to the bottom section.

7. The pontoon boat of claim 6, wherein the lift device includes:

a lift plate slidably attached to the bottom section such that the lift plate is movable relative to the bottom section;

a first linear actuator having a first end attached to the bottom section and a second end attached to the lift plate, the second end being linearly movable relative to the first end;

a second linear actuator having a first end attached to the lift plate and a second end attached to the top section, the second end being linearly movable relative to the first end.

8. The pontoon boat of claim 7, wherein the rigid rear bottom wall defines a channel, and wherein the first and second linear actuators and the lift plate are situated in the channel.

9. The pontoon boat of claim 1, wherein the upper and lower door panels are configured swing outwardly from the rigid front top wall and the rigid front bottom wall.

10. The pontoon boat of claim 1, wherein the rigid front lower and upper door panel portions are both pivotally movable between the open position and the closed position when the privacy enclosure is in both the retracted position and the extended position.

11. The pontoon boat of claim 1, wherein the bottom section defines a recessed area for receiving a toilet.

12. A privacy enclosure, comprising:

a bottom section having a rigid construction including a rigid rear bottom wall, a rigid left bottom wall, a rigid right bottom wall and a rigid front bottom wall, the rigid front bottom wall having a lower door opening therein;

a top section having a rigid construction including a rigid rear top wall, a rigid left top wall, a rigid right top wall, a rigid roof, and a rigid front top wall, the rigid front top wall having an upper door opening therein;

a lift plate slidably attached to the bottom section such that the lift plate is movable relative to the bottom section;

a first linear actuator having a first end attached to the bottom section and a second end attached to the lift plate, the second end being linearly movable relative to the first end such that when actuated the second end slides the lift plate vertically relative to the bottom section;

a second linear actuator having a first end attached to the lift plate and a second end attached to the top section, the second end being linearly movable relative to the first end such that when actuated the second end moves the top section vertically relative to the lift plate and the bottom section.

13. The enclosure of claim 12, wherein the first and second actuators are configured to move the top section telescopically in a vertical orientation relative to the bottom section between a refracted position and an extended position, a majority of the top section projecting upwardly from the bottom section when in the extended position, the top section covering the bottom section when in the retracted position.

14. The enclosure of claim 12, further comprising:

a rigid lower door panel hingedly attached to the rigid front bottom wall;

a rigid upper door panel hingedly attached to the rigid front upper wall;

wherein the rigid upper and lower door panels are independently movable.

15. The enclosure of claim 12, wherein the rigid rear bottom wall defines a channel, and wherein the first and second linear actuators and the lift plate are situated in the channel.

* * * * *